US011532914B2

(12) United States Patent
Su

(10) Patent No.: US 11,532,914 B2
(45) Date of Patent: Dec. 20, 2022

(54) ELECTRICAL CONNECTOR HAVING INSULATING BODY AND A FIRST SHELL FORMING INSERTION SPACE AND A SECOND SHELL COVERING REAR SIDE OF INSULATING BODY AND A METALLIC PLATE CONNECTED WITH THE SECOND SHELL

(71) Applicant: Advanced Connectek Inc., New Taipei (TW)

(72) Inventor: Wen-Hui Su, New Taipei (TW)

(73) Assignee: Advanced Connectek Inc., New Taipei (TW)

( * ) Notice: Subject to any disclaimer, the term of this patent is extended or adjusted under 35 U.S.C. 154(b) by 58 days.

(21) Appl. No.: 17/204,837

(22) Filed: Mar. 17, 2021

(65) Prior Publication Data

US 2021/0296830 A1 Sep. 23, 2021

(30) Foreign Application Priority Data

Mar. 18, 2020 (TW) ..... 109203073

(51) Int. Cl.

| | |
|---|---|
| ***H01R 13/6585*** | (2011.01) |
| ***H01R 24/60*** | (2011.01) |
| ***H01R 13/506*** | (2006.01) |
| ***H01R 13/6596*** | (2011.01) |

(52) U.S. Cl.

CPC ..... *H01R 13/6585* (2013.01); *H01R 13/506* (2013.01); *H01R 13/6596* (2013.01); *H01R 24/60* (2013.01)

(58) Field of Classification Search

CPC .. H01R 12/724; H01R 13/405; H01R 13/502; H01R 13/506; H01R 13/516; H01R 13/6581; H01R 13/6585; H01R 13/6593; H01R 13/6594; H01R 24/60; H01R 43/02; H01R 2107/00

See application file for complete search history.

(56) References Cited

U.S. PATENT DOCUMENTS

| | | | | |
|---|---|---|---|---|
| 8,535,097 | B2 * | 9/2013 | Yen | H01R 13/6594 439/607.4 |
| 9,685,740 | B1 * | 6/2017 | Hsu | H01R 13/521 |
| 2013/0203290 | A1 * | 8/2013 | Zhang | H01R 12/716 439/607.36 |
| 2016/0087378 | A1 * | 3/2016 | Chen | H01R 13/6597 439/607.34 |
| 2016/0352050 | A1 * | 12/2016 | Hu | H01R 13/652 |
| 2018/0062319 | A1 * | 3/2018 | Chang | H01R 13/646 |

* cited by examiner

*Primary Examiner* — Oscar C Jimenez
(74) *Attorney, Agent, or Firm* — JCIPRNET

(57) ABSTRACT

An electrical connector suited for being assembled to a circuit board is provided. The electrical connector includes an insulating body, a plurality of terminals disposed in the insulating body, a first metallic shell sheathing the insulating body to form an insertion space, a second metallic shell superposed on the first metallic shell, and a metallic plate disposed in the insulating body. The second metallic shell has a rear plate opposite to the rear interface, and is not electrically connected to the circuit board. The metallic plate has at least one bending extending out of the insulating body to abut the rear plate, such that the metallic plate and the second metallic shell are electrically conducted.

18 Claims, 6 Drawing Sheets

ELECTRICAL CONNECTOR HAVING INSULATING BODY AND A FIRST SHELL FORMING INSERTION SPACE AND A SECOND SHELL COVERING REAR SIDE OF INSULATING BODY AND A METALLIC PLATE CONNECTED WITH THE SECOND SHELL

CROSS-REFERENCE TO RELATED APPLICATION

This application claims the priority benefit of Taiwan application serial no. 109203073, filed on Mar. 18, 2020. The entirety of the above-mentioned patent application is hereby incorporated by reference herein and made a part of this specification.

BACKGROUND

Technical Field

The present disclosure relates to an electrical connector.

Description of Related Art

As the amount of data transmitted between electronic devices continuously increases, in order to provide users with a more user-friendly experience, the speed of transmitting signals between electronic devices increases. An electrical connector is an electronic signal communication bridge between different electronic devices, so it is frequently applied to various electronic devices with the above situation.

However, under the trend of downsizing electronic device bodies, the size of an electrical connector is required to be reduced. What follows is that it affects the structural stability of the electrical connector package on the circuit board, which is easy to gradually decrease as the number of times the electrical connector is used (mating and plugging) increases.

Accordingly, how to effectively improve the structural strength of the electrical connector configurated on the circuit board under the above-mentioned trend is a problem that people skilled in the art need to consider and solve.

SUMMARY

The present disclosure provides an electrical connector, which is suitable for being assembled on a circuit board. The electrical connector has a double housing disposed outside the insulating body, wherein the outer housing has a rear plate which shields the insulating body, and the rear plate is not electrically connected to the circuit board.

In an exemplary embodiment, an electrical connector is provided for assembling on a circuit board. The electrical connector includes an insulating body, a plurality of terminals, a first metallic shell, a second metallic shell, and a metallic plate. The terminals are disposed in the insulating body, the first metallic shell is sheathed the insulating body to form an insertion space, and the second metallic shell is superposed on the first metallic shell. The second metallic shell has a rear plate which shields the insulating body and is located on the opposite side of the interface. The rear plate is not electrically connected to a ground plate. The metallic plate is disposed in the insulating body, and has at least one bending portion extending out of the insulating body to abut the rear plate, so that the metallic plate and the second metallic shell are electrically conducted.

In an exemplary embodiment, the first metallic shell has a first main plate, and a pair of first side plates extending and bending from the first main plate and facing each other. The second metallic shell has a second main plate, a pair of second side plates extending and bending from the second main plate and facing each other, and a rear plate extending and bending from the second main plate. The second main plate and the second side plates are superposed on the first main plate and the first side plates correspondingly.

In an exemplary embodiment, the rear side surface of the insulating body is exposed from between the first side plates, and the rear plate covers the rear side surface.

In an exemplary embodiment, the first side plates and the second side plates have a grounding structure, and the rear plate does not have a grounding structure.

In an exemplary embodiment, the electrical connector is adapted to a circuit board, wherein a bottom side of the rear plate is a linear side edge facing the circuit board, and the linear side edge keeps a gap with the circuit board.

In an exemplary embodiment, the rear plate does not have a grounding structure connected to the circuit board.

In an exemplary embodiment, the metallic plate separates the terminals at two places, and the bending portion is located at the corresponding position of the outermost terminal.

In an exemplary embodiment, along the arrangement axis of the plurality of terminals at one of the places, the metallic plate has a pair of wing portions located on opposite sides of the terminals, and at least one of the wing portions has the bending portion.

In an exemplary embodiment, the rear plate is locked to the insulating body.

In an exemplary embodiment, the electrical connector is a socket electrical connector, and the first metallic shell and the second metallic shell are metal housings.

Based on the above, the electrical connector includes the insulating body and the first metallic shell and the second metallic shell disposed outside the insulating body, wherein the first metallic shell is sheathed the insulating body and the rear side surface is exposed, and then the second metallic shell is superposed on the first metallic shell, such that the rear plate of the second metallic shell covers the rear side surface exposed from the first metallic shell. Additionally, the rear plate is only used to cover the rear side surface, and the bottom side has a smooth contour without electrically connecting to the circuit board, and therefore additional and unnecessary protruding grounding structures may be saved, thereby simplifying the second metallic shell, and no damaging the electrical connection characteristics and structural strength of the electrical connector. Moreover, the metallic plate is disposed in the insulation body, and the metallic plate has at least one bending portion, which extends out of the insulating body and abuts the rear plate, so that the metallic plate and the second metallic shell are electrically connected.

DESCRIPTION OF THE EMBODIMENTS

Figure 1:
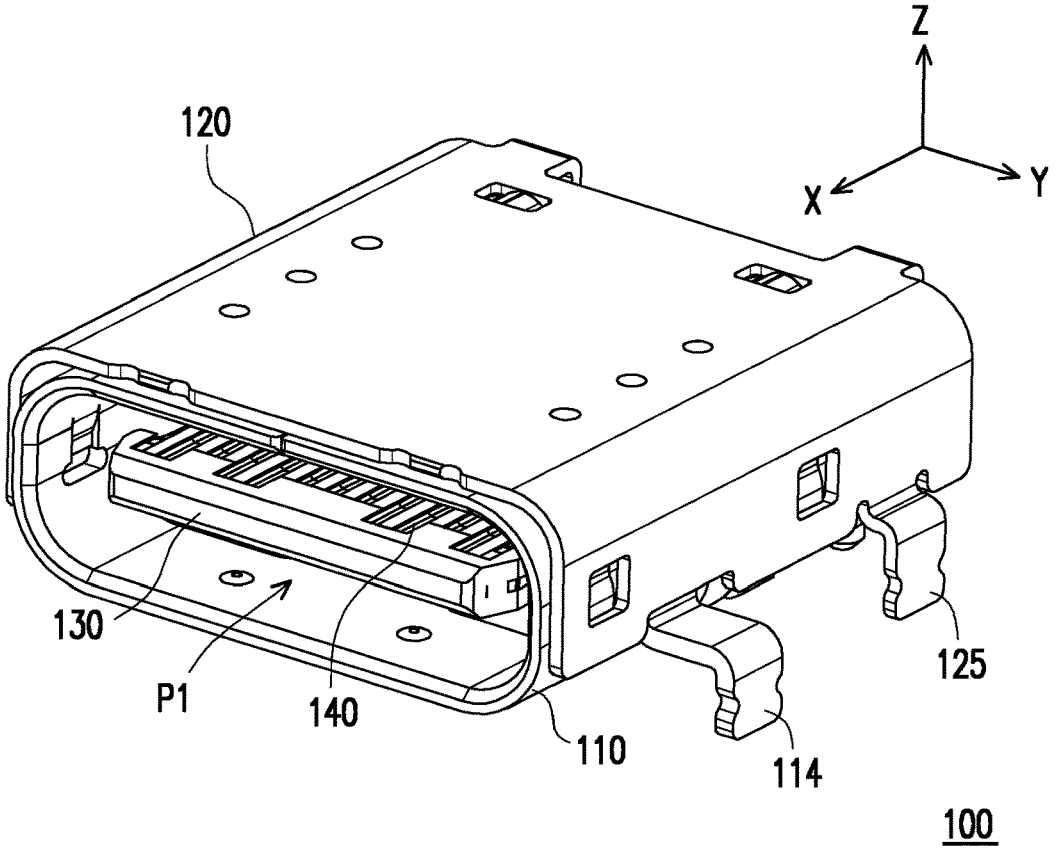
FIG. 1 is a schematic diagram of an electrical connector according to an exemplary embodiment of the present disclosure.
Figure 2:
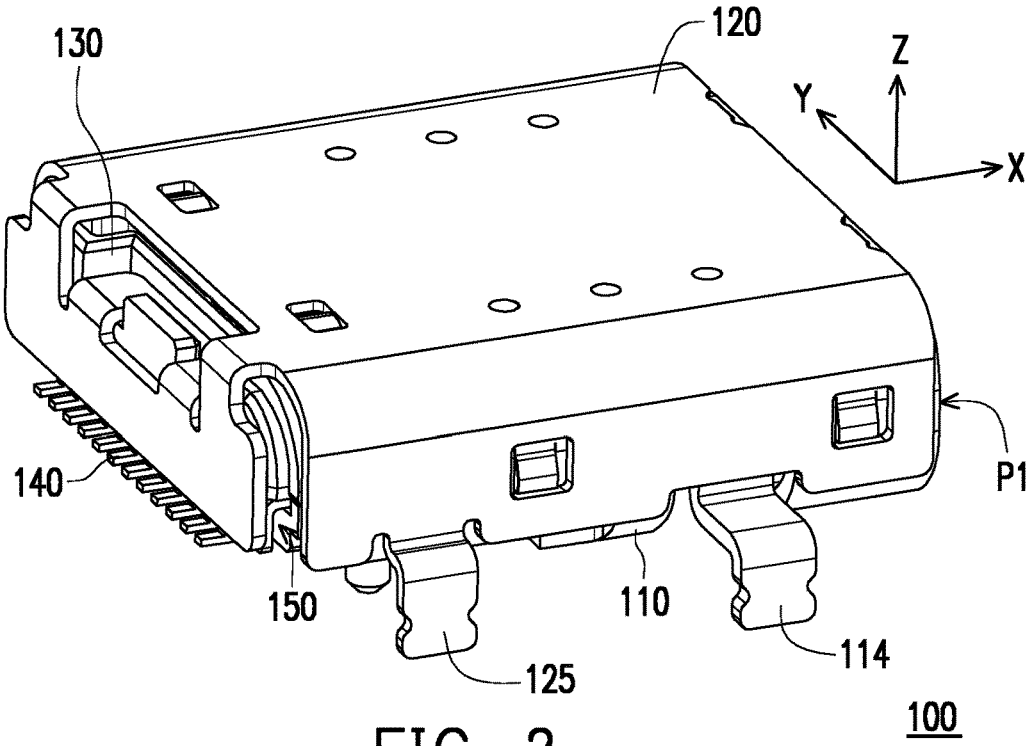
FIG. 2 illustrates the electrical connector of FIG. 1 from another perspective.
Figure 3A:
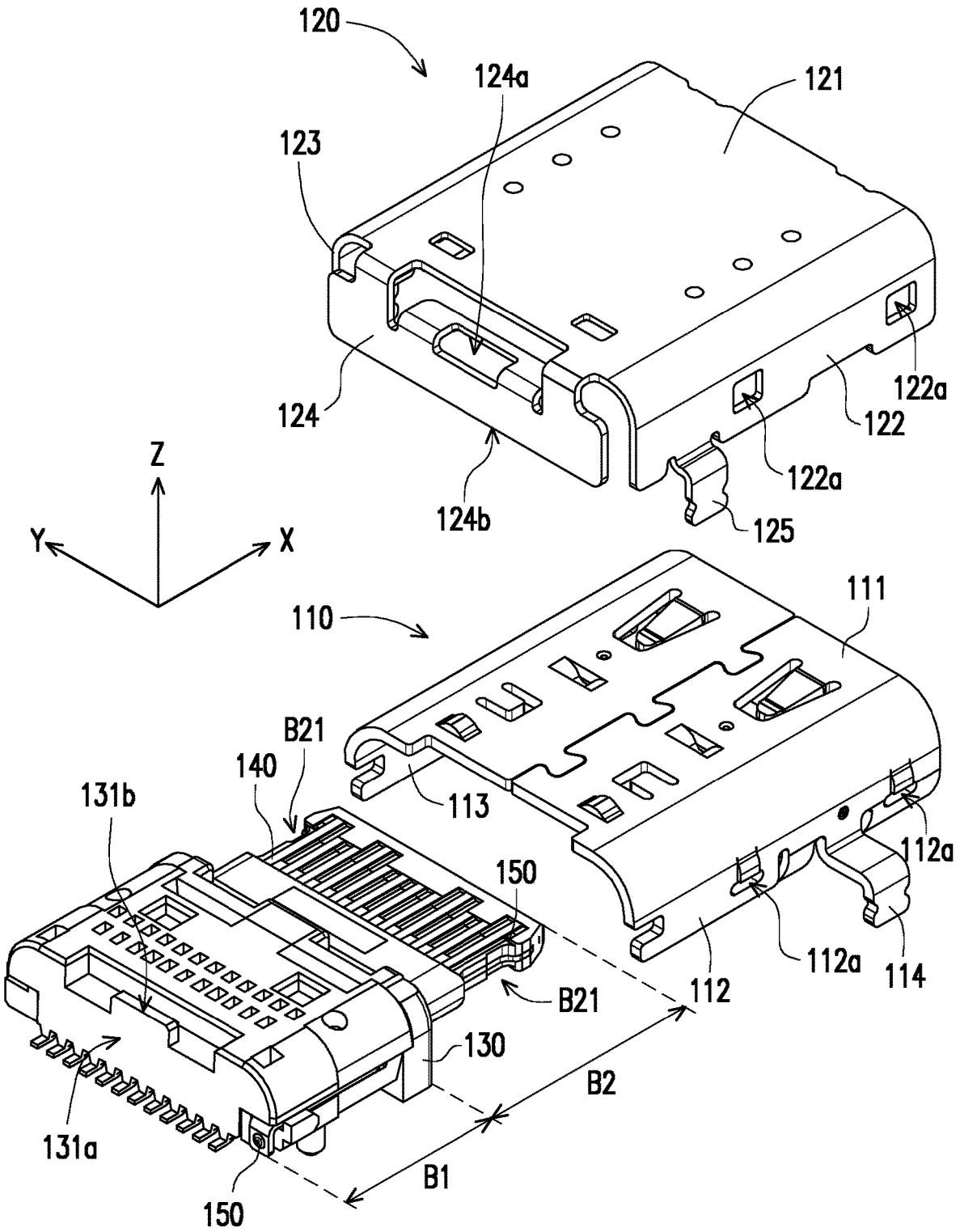
FIG. 3A and FIG. 3B are exploded views of the electrical connector from different perspectives.
Figure 3B:
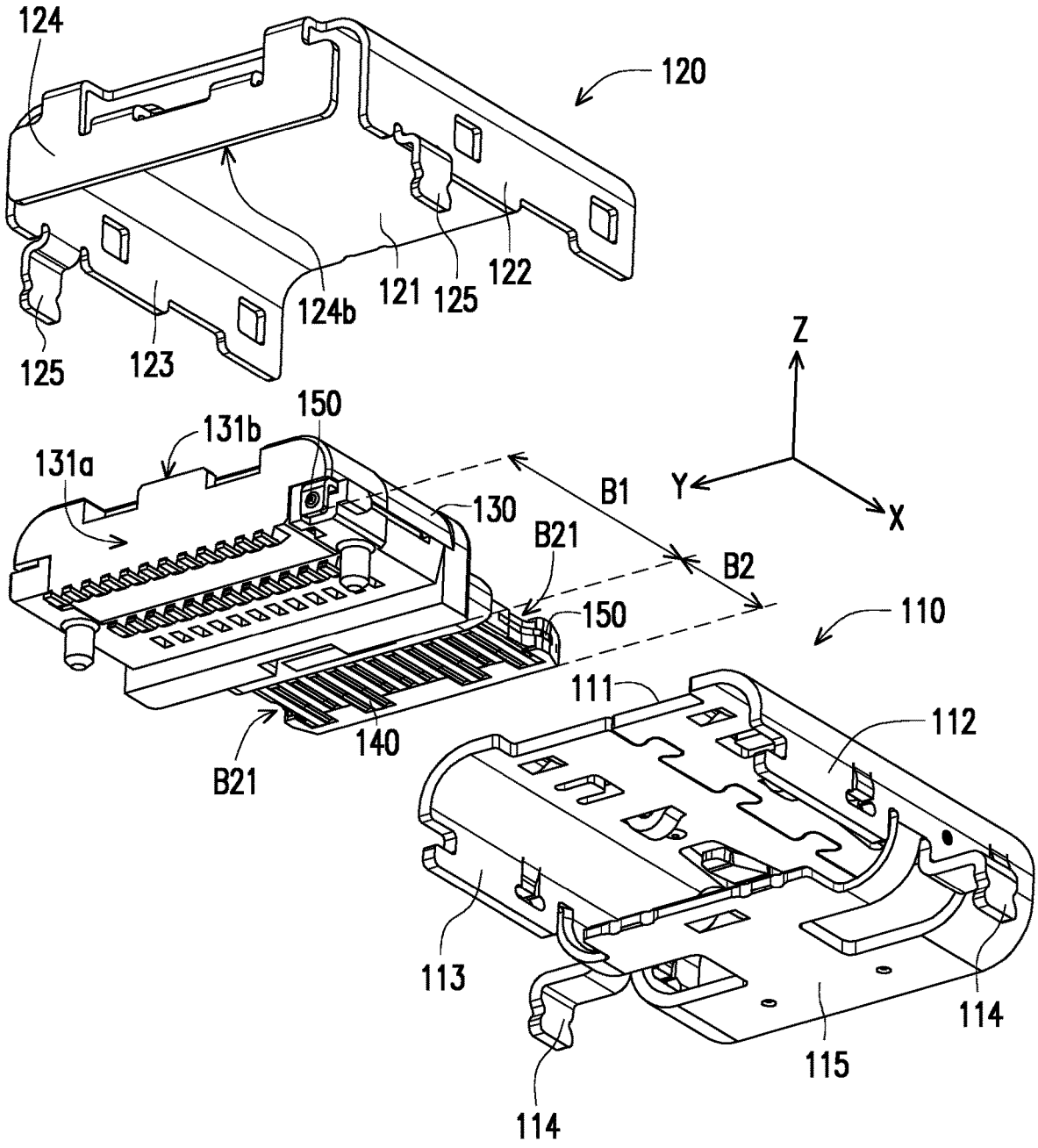
Figure 4:
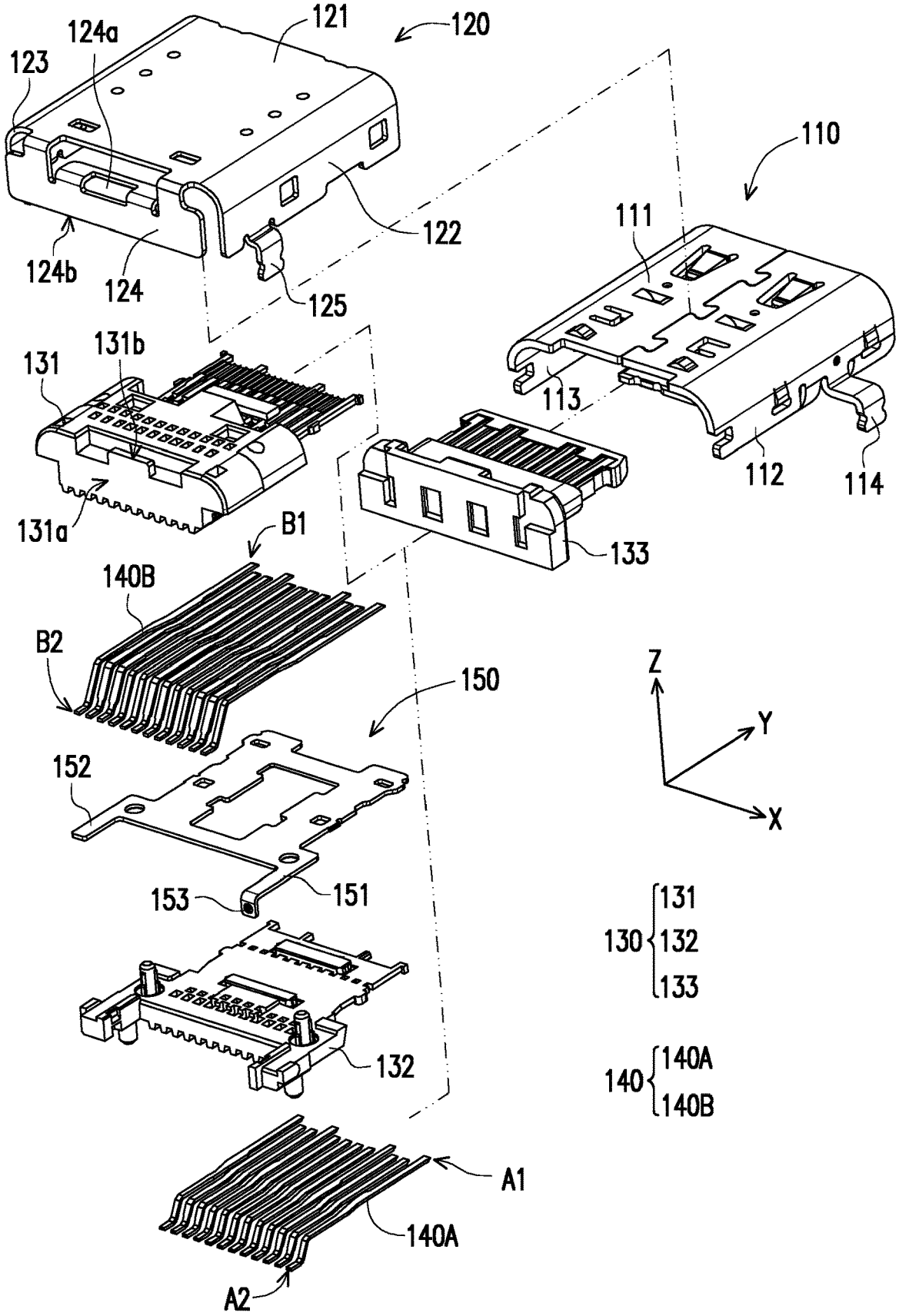
FIG. 4 is another exploded view of the electrical connector.

FIG. 1 is a schematic diagram of an electrical connector according to an exemplary embodiment of the present disclosure. FIG. 2 illustrates the electrical connector of FIG. 1 from another perspective. FIG. 3A and FIG. 3B are exploded views of the electrical connector from different perspectives. FIG. 4 is another exploded view of the electrical connector. Here, FIG. 1 and FIG. 2 provide only the upper label first, and then the labels of detailed parts are provided in FIG. 3A, FIG. 3B, and FIG. 4 to facilitate viewing and identifying. Meanwhile, a rectangular coordinate X-Y-Z is provided as a basis for describing the components in the present exemplary embodiment.

Referring to FIG. 1, FIG. 2 and FIG. 3A, in the present exemplary embodiment, the electrical connector 100 includes an insulating body 130, a plurality of terminals 140, a first metallic shell 110 and a second metallic shell 120. The terminals 140 is disposed in the insulating body 130, the first metallic shell 110 is sheathed the insulating body 130, and the second metallic shell 120 is superposed on the first metallic shell 110. The insulating body 130 forms an insertion space P1 with the first metallic shell 110 to connect with another electrical connector (not shown). The second metallic shell 120 is used for the outermost housing structure of the electrical connector 100, and has a rear plate 124 that covers and shields the insulating body 130. The rear plate 124 is opposite to the insertion space P1 and the bottom side 124*b* of the rear plate 124 has a smooth contour.

Herein, in terms of the overall structure of the electrical connector 100, it has an insertion space P1 on the front side along the X-axis, and the rear plate 124 is located on the rear side (equivalent to the opposite side of the insertion space P1) along the X-axis to be opposite to the insertion space P1.

Referring to FIG. 3A, FIG. 3B and FIG. 4, in the present exemplary embodiment, the first metallic shell 110 has a first main plate 111, a bottom plate 115, and a pair of side plates 112, 113 extending and bending from the first main plate 111 and facing each other. And, the bottom plate 115 is adjacent between the first side plates 112 and 113. Furthermore, the first side plate 112, the first main plate 111, the first side plate 113, and the bottom plate 115 are substantially adjacent to each other to form a ring structure arranged around the X-axis, and are used to be sheathed the insulating body 130 to form the insertion space P1. Additionally, the second metallic shell 120 has a second main plate 121, a pair of second side plates 122, 123 extending and bending from the second main plate 121 and facing each other, and a rear plate 124 extending and bending from the second main plate 121. That is, the second side plate 122, the second main plate 121, and the second side plate 123 are sequentially adjacent to form the second metallic shell 120 having a ⊓-shaped contour.

In addition, referring to FIG. 4., the insulating body 130 is composed of components 131, 132, and 133. The terminals 140 are embedded in the insulating body 130 through an in-mold injection process and a part of each terminals 140 is exposed out of the insulating body 130. When the first metallic shell 110 is sheathed the insulating body 130 as described above, the component 131 of the insulating body 130 has a rear side surface 131*a*, which is exposed from between the first side plates 112 and 113. Then, the second metallic shell 120 is assembled on the first metallic shell 110, in which the second main plate 121 and the second side plates 122 and 123 are respectively superposed on the first main plate 111 and the first side plates 112 and 113, and more importantly, the rear plate 124 of the second metallic shell 120 covers and shields the rear side surface 131*a* of the insulating body 130 which is exposed from the first metallic shell 110.

Figure 5:
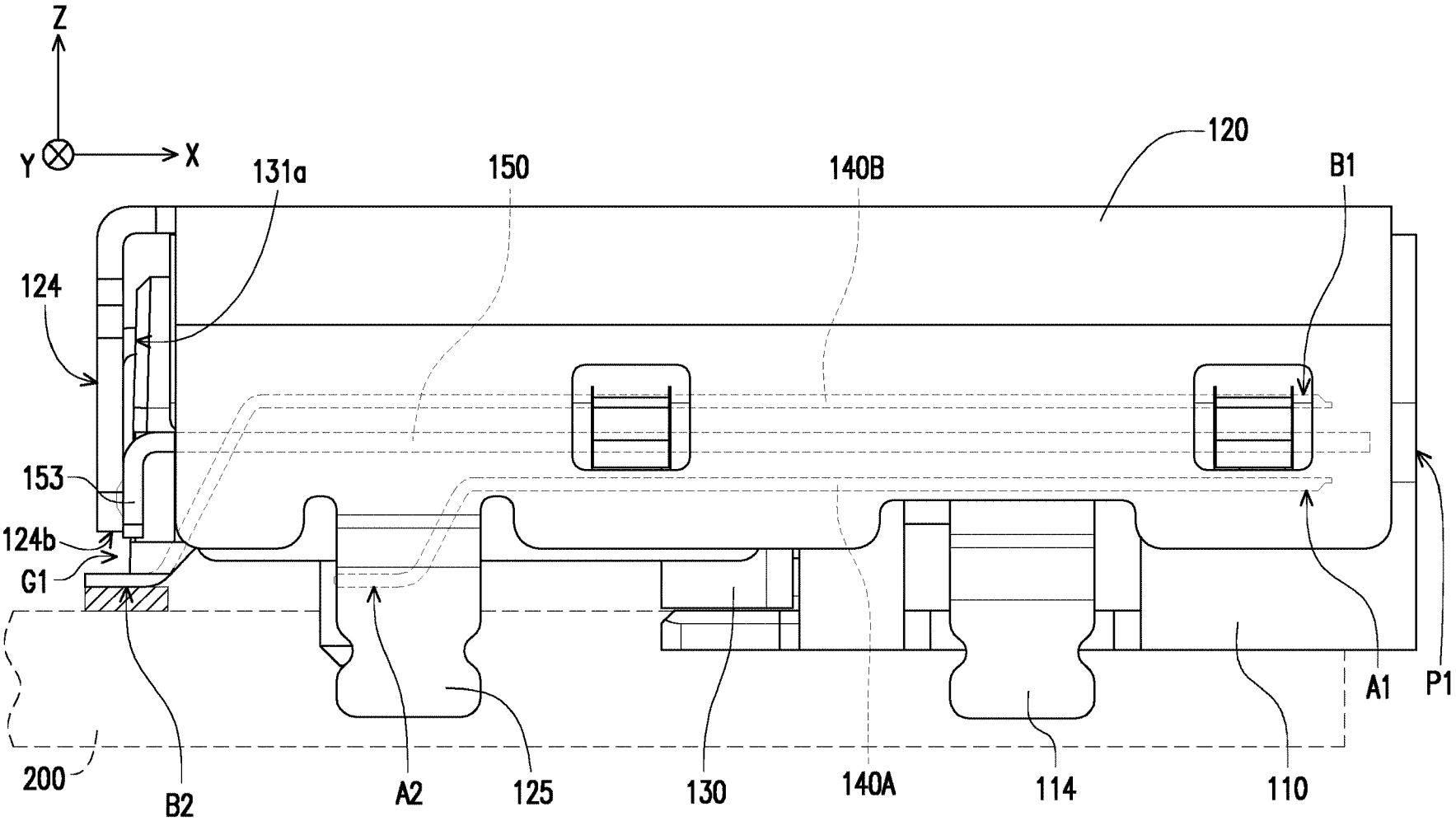
FIG. 5 is a side view of the electrical connector.

FIG. 5 is a side view of the electrical connector. Referring to FIG. 4 and FIG. 5, in the present exemplary embodiment, the electrical connector 100 is, for example, a socket electrical connector, which is adapted to the circuit board 200 and has an electrical connection relationship with related lines of the circuit board 200. The bottom side 124*b* of the rear plate 124 is a linear side edge facing the circuit board 200, and there is a gap G1 between the linear side edge and the circuit board 200. In other words, the rear plate 124 does not need to have a structure connected to the circuit board 200, and furthermore, the rear plate 124 of the present exemplary embodiment does not need a physical grounding structure. The details are described as follows.

As mentioned above, after the electrical connector 100 is configured on the circuit board 200, it must have an electrical connection relationship with the relevant lines of the circuit board 200, which also includes electrical grounding. In the present exemplary embodiment, the first metallic shell 110 and the second metallic shell 120 are metal housings, and respectively have grounding structures 114 and 125, which are electrically connected to a ground circuit layer (not shown) of the circuit board 200. The grounding structure 114 is located at the first side plates 112 and 113 of the first case 110, and the grounding structure 125 is located at the second side plates 122 and 123 of the second metallic shell 120. Accordingly, the staggered grounding structures 114, 125 have provided the ground connection relationship between the electrical connector 100 and the circuit board 200, so additional grounding structure for the rear plate 124 of the second metallic shell 120 is not needed. Therefore, the rear plate 124 of the present exemplary embodiment has a simple appearance, and the manufacturing process may be simplified and manufacturing costs may be reduced. That is, the rear plate 124 of the second metallic shell 120 in the present exemplary embodiment does not directly contact the circuit board 200 to form a grounding loop. That is, the rear plate 124 does not need a physical grounding structure.

The grounding structures 114 and 125 of the first metallic shell 110 and the second metallic shell 120 are represented as ground pins inserted into the circuit board 200 and in the structure, the first metallic shell 110 and the second metallic shell 120 can also maintain a better structural strength with the circuit board 200 due to the ground pins.

As shown in FIG. 3A, the first metallic shell 110 has a convex portion 112*a* located on the first side plate 112 (the same is true for the other first side plate 113, which is not shown only because of the viewing angle), and the second metallic shell 120 has a buckle hole 122*a* located on the second side plate 122 (the same is true for the other second side plate 123, which is not shown only because of the viewing angle). Therefore, by clamping the convex portion 112*a* to the buckle hole 122*a*, the second metallic shell 120 is smoothly assembled on the first metallic shell 110. Furthermore, as shown in FIG. 2, FIG. 3A, FIG. 3B, and FIG. 4, the rear plate 124 of the second metallic shell 120 has a buckle hole 124*a*, and the insulating body 130 has a convex portion 131*b* located on the rear side surface 131*a*. When the second metallic shell 120 is assembled to the first metallic shell 110, the buckle hole 124*a* is sheathed the convex portion 131*b*, such that the rear plate 124 can be locked to the insulating body 130.

Accordingly, the insulating body 130, the first metallic shell 110, and the second metallic shell 120 are combined tightly through the above-mentioned circulation, such that the electrical connector 100 can have better structural strength, and therefore can withstand insertion and removal forces when mating with another electrical connector, thereby effectively improving the service life of the electrical connector 100.

Referring to FIG. 4 and FIG. 5, the electrical connector 100 of the present exemplary embodiment further includes a metallic plate 150, which is disposed on the insulating body 130 and separates the terminals 140 in two places. As shown in FIG. 4, the metallic plate 150 separates the terminals 140 into a first group of terminals 140A and a second group of terminals 140B, which are arranged along the Z-axis, and the metallic plate 150 is spaced between them. Herein, in addition to providing an electromagnetic shielding effect to avoid electromagnetic interference between the first group of terminals 140A and the second group of terminals 140B, the metallic plate 150 can also be electrically connected to the first metallic shell 110 and the second metallic shell 120 to provide the effect of electromagnetic shielding and electrical grounding required by the electrical connector 100. Besides, referring to FIGS. 3A and 3B, the metallic plate 150 is disposed in middle level of a tongue portion B2 of the insulating body 130 and separates the terminals 140 which are disposed on two surfaces of the tongue portion B2 of the insulating body 130, two side edges of the metallic plate 150 are respectively and partially exposed out two side edges of the tongue portion B2 of the insulating body 130, wherein the insulating body 130 comprises a base portion B1 and the tongue portion B2 extending from the base portion B1, two depressed regions B21 are respectively formed on two sides of the tongue portion B2, the terminals 140 are partially disposed on two tongue surfaces of the tongue portion B2, and the two side edges of the metallic plate 150 are exposed on the two depressed regions B21 formed on the tongue portion B2. The detail is described later.

The metallic plate 150 of the present exemplary embodiment has at least one bending portion 153, which extends and exposes the insulating body 130 and abuts against the rear plate 124. And, for the first group of terminals 140A and the second group of terminals, the bending portion 153 is both located at the corresponding position of the outermost terminal 140B (as shown in FIG. 4, the bending portion 153 corresponds to the rightmost terminal of the first group of terminals 140A, and also corresponds to the rightmost terminal of the second group of terminals 140B). Furthermore, taking the first group of terminals 140A as an example, along the arrangement axis of one of the terminals 140 (that is, the Y-axis shown in the figure), the metallic plate 150 has a pair of wing portions 151, 152, which is essentially located on opposite sides of the first group of terminals 140A, and the end of at least one of the wing portions 151, 152 has a bending portion 153.

After the assembling process of the second metallic shell 120 is completed, as shown in FIGS. 3A and 3B, the bending portion 153 is substantially adjacent to the rear side surface 131*a*, so it can smoothly abut against the rear plate 124 of the second metallic shell 120. Although the present exemplary embodiment takes the bending portion 153 located on the wing portion 151 as an example, in another exemplary embodiment (not shown), the bending portion 153 may also be disposed in the wing portion 152, or both of the wing portions 151, 152 have a bending portion 153. Furthermore, as shown in FIG. 5, the metallic plate 150 separates the terminals 140 into the second group of terminals 140B and the first group of terminals 140A which are arranged close to and above. The first group of terminals 140A respectively have end portions A1 and A2, which are opposite to each other, and the second group of terminals 140B respectively have end portions B1 and B2 which are opposite to each other. The end portions A1, B1 are adjacent to the insertion space P1, and the end portions A2, B2 are away from the insertion space P1, and the bending portion 153 is adjacent to the end portion B2.

Figure 6:
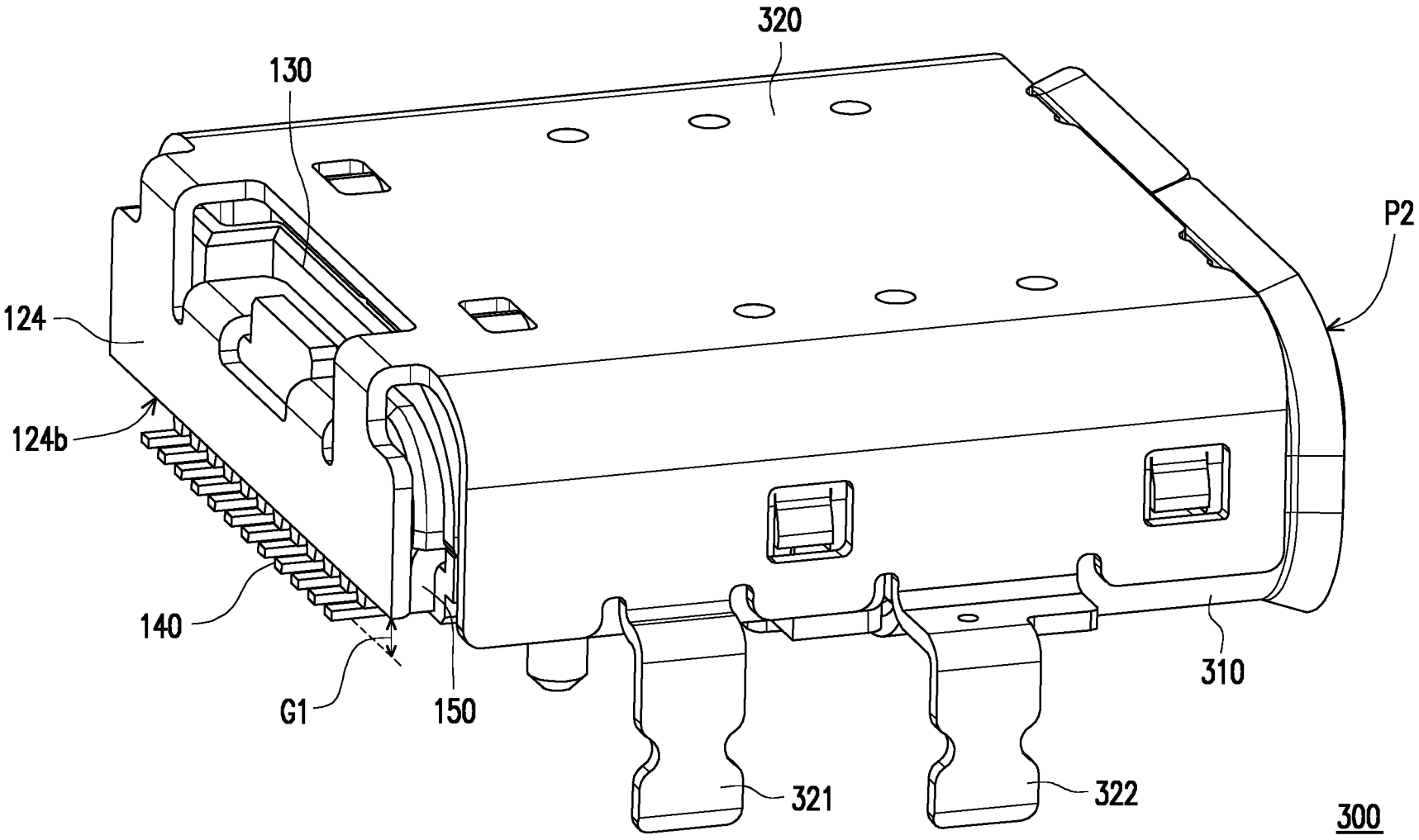
FIG. 6 is a schematic diagram of an electrical connector according to another exemplary embodiment of the present disclosure.

FIG. 6 is a schematic diagram of an electrical connector according to another exemplary embodiment of the present disclosure. Referring to FIG. 6, unlike the previous exemplary embodiment, in the electrical connector 300 of the present exemplary embodiment, the first metallic shell 310 assembled to the insulating body 130 does not have a grounding structure, and the grounding structures 321 and 322 are disposed on the second metallic shell 320, wherein the grounding structure 322 is similar to the grounding structure 114 and is adjacent to the insertion space P1, and the grounding structure 321 is similar to the grounding structure 125 and is far from the insertion space P1. Other structural features are the same as those of the previous exemplary embodiment, and the reference numerals are the same as those of the previous exemplary embodiment, and the description will not be repeated here.

In summary, in the above-mentioned exemplary embodiment, the electrical connector includes the insulating body and the first metallic shell and the second metallic shell disposed outside the insulating body, wherein the first metallic shell is sheathed the insulating body and exposed the rear side, and then the second metallic shell is superposed on the first metallic shell, such that the rear plate of the second metallic shell may cover the rear side surface exposed from the first metallic shell.

Furthermore, the grounding structures are disposed on the side plates of the first and second metallic shells, such that the rear plate is only used to cover the rear side surface, and the bottom side has the smooth contour and keeps a gap with the circuit board without the grounding structure. Accordingly, additional and unnecessary protruding structures for grounding to the circuit board may be saved, thereby simplifying the structure of the second metallic shell and no damaging the electrical connection characteristics and structural strength of the electrical connector.

What is claimed is:

1. An electrical connector, the electrical connector comprising:

an insulating body;

a plurality of terminals, disposed in the insulating body;

a first shell sheathed on the insulating body to form an insertion space for connecting to another electrical connector;

a second shell superposed on the first shell, wherein the second shell has a rear plate for covering a rear side of the insulating body, the rear side of the insulating body is located on an opposite side of the insertion space along an insertion direction; and a metallic plate, disposed in the insulating body, the metallic plate has at least one bending portion, wherein the bending portion extends out of the insulating body and abuts the rear plate and the metallic plate is electrically connected with the second shell, wherein the first shell has a first main plate and a pair of first side plates extending from the first main plate and facing each other, wherein the second shell has a second main plate, a pair of second side plates extending and bending from the second main plate, and the rear plate extending and bending from the second main plate, wherein the second main plate and the pair of second side plates are superposed correspondingly on the first main plate and the pair of first side plates, wherein the pair of first side plates respectively have at least one first convex portion, the pair of second side plates respectively have at least one first buckle hole, the rear plate has a second buckle hole, the insulating body has a second convex portion, when the second shell is assembled to the first shell, the at least one first convex portion is clamped to the at least one first buckle hole, and the second convex portion is clamped to the second buckle hole.

2. The electrical connector according to claim 1, wherein a rear side surface of the insulating body is exposed from between the pair of first side plates, and the rear plate covers the rear side surface.

3. The electrical connector according to claim 1, wherein the pair of first side plates and the pair of second side plates have grounding structures, and the rear plate does not have a grounding structure.

4. The electrical connector according to claim 1, wherein the electrical connector is adapted to a circuit board, and a bottom side of the rear plate is a linear side edge facing the circuit board, and the linear side edge keeps a gap with the circuit board.

5. The electrical connector according to claim 4, wherein the bottom side of the rear plate is smooth without a grounding structure connected to the circuit board.

6. The electrical connector according to claim 1, wherein the metallic plate is disposed in middle level of a tongue portion of the insulating body and separates the terminals which are disposed on two surfaces of the tongue portion of the insulating body, two side edges of the metallic plate are respectively and partially exposed out two side edges of the tongue portion of the insulating body, and the bending portion is located at a corresponding position of the outermost terminal.

7. The electrical connector according to claim 6, wherein along the arrangement axis of the terminals at one of the places, the metallic plate has a pair of wing portions located on opposite sides of the terminals, and at least one of the pair of wing portions has the bending portion.

8. The electrical connector according to claim 1, wherein the rear plate is locked to the insulating body.

9. The electrical connector according to claim 1, which is an electrical receptacle connector, and the first shell and the second shell are metallic shells.

10. An electrical connector for adapting to a circuit board, the electrical connector comprising:

an insulating body comprising a base portion and a tongue portion, wherein two depressed regions are respectively formed on two sides of the tongue portion;

a plurality of terminals, disposed in the insulating body and partially disposed on two tongue surfaces of the tongue portion;

a first shell sheathed on the insulating body to form an insertion space for connecting to another electrical connector;

a second shell superposed on the first shell, wherein the second shell has a rear plate for covering a rear side of the insulating body and the rear side of the insulating body is located on an opposite side of the insertion space along an insertion direction; and a metallic plate, disposed in the insulating body, the metallic plate is disposed in middle level of a tongue portion of the insulating body and separates the terminals which are disposed on two surfaces of the tongue portion of the insulating body, two side edges of the metallic plate are respectively and partially exposed on the two depressed regions formed on two side edges of the tongue portion of the insulating body, and the metallic plate has at least one bending portion, wherein the bending portion extends out of the insulating body and abuts the rear plate and the metallic plate is electrically connected with the second shell, wherein the first shell has a first main plate and a pair of first side plates extending from the first main plate and facing each other, wherein the second shell has a second main plate, a pair of second side plates extending and bending from the second main plate, and the rear plate extending and bending from the second main plate, wherein the second main plate and the pair of second side plates are superposed correspondingly on the first main plate and the pair of first side plates, wherein the pair of first side plates respectively have at least one first convex portion, the pair of second side plates respectively have at least one first buckle hole, the rear plate has a second buckle hole, the insulating body has a second convex portion, when the second shell is assembled to the first shell, the at least one first convex portion is clamped to the at least one first buckle hole, and the second convex portion is clamped to the second buckle hole.

11. The electrical connector according to claim 10, wherein a rear side surface of the insulating body is exposed from between the pair of first side plates, and the rear plate covers the rear side surface.

12. The electrical connector according to claim 10, wherein the pair of first side plates and the pair of second side plates have grounding structures, and the rear plate does not have a grounding structure.

13. The electrical connector according to claim 10, wherein a bottom side of the rear plate is a linear side edge facing the circuit board, and the linear side edge keeps a gap with the circuit board.

14. The electrical connector according to claim 13, wherein the bottom side of the rear plate is smooth without a grounding structure connected to the circuit board.

15. The electrical connector according to claim 10, wherein the bending portion is located at a corresponding position of the outermost terminal.

16. The electrical connector according to claim 15, wherein along the arrangement axis of the terminals at one of the places, the metallic plate has a pair of wing portions located on opposite sides of the terminals, and at least one of the pair of wing portions has the bending portion.

17. The electrical connector according to claim 10, wherein the rear plate is locked to the insulating body.

18. The electrical connector according to claim 10, which is an electrical receptacle connector, and the first shell and the second shell are metallic shells.

* * * * *